US012181173B2

(12) United States Patent
Kilievoi

(10) Patent No.: US 12,181,173 B2
(45) Date of Patent: Dec. 31, 2024

(54) LINEAR AIR DIFFUSER OF A SUSPENDED CEILING

(71) Applicant: OSAÜHING VECTA DESIGN, Pärnu (EE)

(72) Inventor: Vitalii Kilievoi, Pärnu (EE)

(73) Assignee: OSAÜHING VECTA DESIGN, Pärnu (EE)

( * ) Notice: Subject to any disclaimer, the term of this patent is extended or adjusted under 35 U.S.C. 154(b) by 267 days.

(21) Appl. No.: 17/772,377

(22) PCT Filed: Nov. 3, 2020

(86) PCT No.: PCT/IB2020/060320
§ 371 (c)(1),
(2) Date: Apr. 27, 2022

(87) PCT Pub. No.: WO2021/090173
PCT Pub. Date: May 14, 2021

(65) Prior Publication Data

US 2022/0373217 A1 Nov. 24, 2022

(30) Foreign Application Priority Data

Nov. 5, 2019 (EE) ..... U201900060

(51) Int. Cl.
*F24F 13/072* (2006.01)
*E04B 9/02* (2006.01)

(52) U.S. Cl.
CPC ..... *F24F 13/072* (2013.01); *E04B 9/02* (2013.01)

(58) Field of Classification Search
CPC ..... F24F 13/072; E04B 9/02
USPC ..... 454/303
See application file for complete search history.

(56) References Cited

U.S. PATENT DOCUMENTS 3,177,796 A 4/1965 Lee et al.
3,383,999 A * 5/1968 Fragnito ..... F24F 13/072 236/49.4
3,554,112 A * 1/1971 Herb ..... F24F 13/072 251/5
3,733,995 A * 5/1973 Brown ..... F24F 13/072 248/343

(Continued)

FOREIGN PATENT DOCUMENTS

GB 2087451 A 5/1982
JP H05-156741 A 6/1993

OTHER PUBLICATIONS

PCT/IB2020/060320, International Search Report dated Feb. 25, 2021, 3 pages.

(Continued)

*Primary Examiner* — Avinash A Savani
*Assistant Examiner* — Dana K Tighe
(74) *Attorney, Agent, or Firm* — Koivula & Somersalo, LLC

(57) ABSTRACT

A linear air diffuser for a suspended ceiling, which allows using a stretch ceiling material or any other suspended ceiling material or both simultaneously (installed on different sides of the profile) and also enables covering the point of connection of the mounting profile and stretch ceiling material or suspended ceiling material. The linear air diffuser also functions as a partition in a stretch ceiling.

5 Claims, 2 Drawing Sheets

(56) References Cited

U.S. PATENT DOCUMENTS

| | | | | | |
|---|---|---|---|---|---|
| 3,757,668 | A * | 9/1973 | Dean, Jr. | F24F 13/072 | 454/301 |
| 3,784,141 | A | 1/1974 | Rachlin et al. | | |
| 3,919,928 | A | 11/1975 | Lambert | | |
| 3,974,755 | A * | 8/1976 | Honmann | F24F 13/06 | 137/829 |
| 4,703,685 | A * | 11/1987 | Meckler | F21V 33/0088 | 454/301 |
| 5,141,473 | A * | 8/1992 | Swaney | F24F 13/072 | 454/301 |
| 5,433,662 | A * | 7/1995 | Hungerford | F24F 13/072 | 454/303 |
| 6,386,970 | B1 * | 5/2002 | Vernier, II | F24F 13/072 | 454/304 |

OTHER PUBLICATIONS

PCT/IB2020/060320, Written Opinion of the International Searching Authority dated Feb. 25, 2021, 6 pages.

* cited by examiner

LINEAR AIR DIFFUSER OF A SUSPENDED CEILING

CROSS REFERENCES

This is a U.S. national application of the international application number PCT/IB2020/060320 filed on Nov. 3, 2020 and claiming priority of Estonian utility model application U201900060 filed on Nov. 5, 2019, the contents of both of which are incorporated herein by reference.

TECHNICAL FIELD

The invention belongs in the field of construction, specifically the invention relates to a linear air diffuser for a suspended ceiling, being a perforated mounting profile for a stretch ceiling together with an air diffuser profile mounted thereto, connected to the air outlet of an indoor ventilation unit.

PRIOR ART

Known is the Extenzo ClimaClick ventilation solution for a stretch ceiling, which collects either heated or cooled air between the base ceiling and the stretch ceiling and diffuses it downwards along the walls (http://solutionceilings.com/climaclick/). The solution is deficient in that the air supplied into the room is deflected unevenly, as the air in the centre remains still and/or uncirculated in case of a larger room, meaning that the air is either warm or cold by the walls of the room and vice versa in the centre of the room.

Known is a linear air diffuser (CH663081, AMCASA SA, published 13 Nov. 1987), which is integrated in a suspended ceiling. For homogenous air diffusion, the linear air diffuser comprises a housing, which is supplied with a cover for connecting the air ducts, an air flow regulator, intermediate ducts, air flow diffuser, a nozzle for directing the air flow into the environment, a cover and adjustable ceiling bracket. A disadvantage of this solution is that it cannot be used with a stretch ceiling.

The closest to the invention by its technical nature is the linear air diffuser INDUL by Kiefer Luft-und Klimatechnik GmbH (https://www.kieferklima.de/en/products/linear-diffuser-indul/), which comprises a plenum box, air flow regulator, mounting profile and an air flow profile mounted thereto separately, with a top drop-shaped air deflector, connected at an acute angle, with two sides and supplied with air openings, mounting brackets. A horizontal fastening element is attached to the mounting profile for installation of the suspended ceiling material (e.g. gypsum board, boarding, etc.). A disadvantage of this solution is that it cannot be used with a stretch ceiling.

SUMMARY OF THE INVENTION

The subject of the invention is a linear air diffuser for a suspended ceiling and the objective is to present a perforated mounting profile which is connected to the air outlet of indoor air ventilation unit, together with an air diffuser profile attached thereto, which ensure mounting of a stretch ceiling as well as a supplementary suspended ceiling material and directing the air flow from the ventilation unit uniformly and at the appropriate angle across the whole room. As the linear air diffuser crosses through the suspended ceiling, it also functions as a partition in a stretch ceiling.

The presented invention comprises an insulated plenum box with two chambers, which has a ventilation opening and air flow regulator, a perforated mounting profile attached to the air outlet and an air diffuser profile attached thereto, consisting of two lateral edges with slits and connected at an acute angle, which are joined at the top with a drop-shaped air deflector. The mounting profile is formed of a perforated H profile with a horizontal connection surface, at the bottom of the external sides of the lower part of the mounting profile is a downwards channel to which the stretch ceiling material is attached, on the outer side of the channel there is a mounting bracket at the right angle, where the external wall of the vertical part has vertical grooves and the mounting bracket is intended for attaching the suspended ceiling material to the mounting profile. At the lower end of the inner sides of the lower part of the mounting profile there is a groove which opens downwards, for attaching the air deflector profile. In the middle of the lateral edges, the air deflector profile comprises a vertical protrusion with a widened end by which the air deflection profile is mounted to the groove of the mounting profile and the lateral edge of the air diffuser profile has the bottom edge for supplementary fastening of a suspended ceiling material, projecting horizontally and covering the connection point of the materials of the stretch ceiling and suspended ceiling.

LIST OF FIGURES

EMBODIMENT OF THE INVENTION

Figure 1:
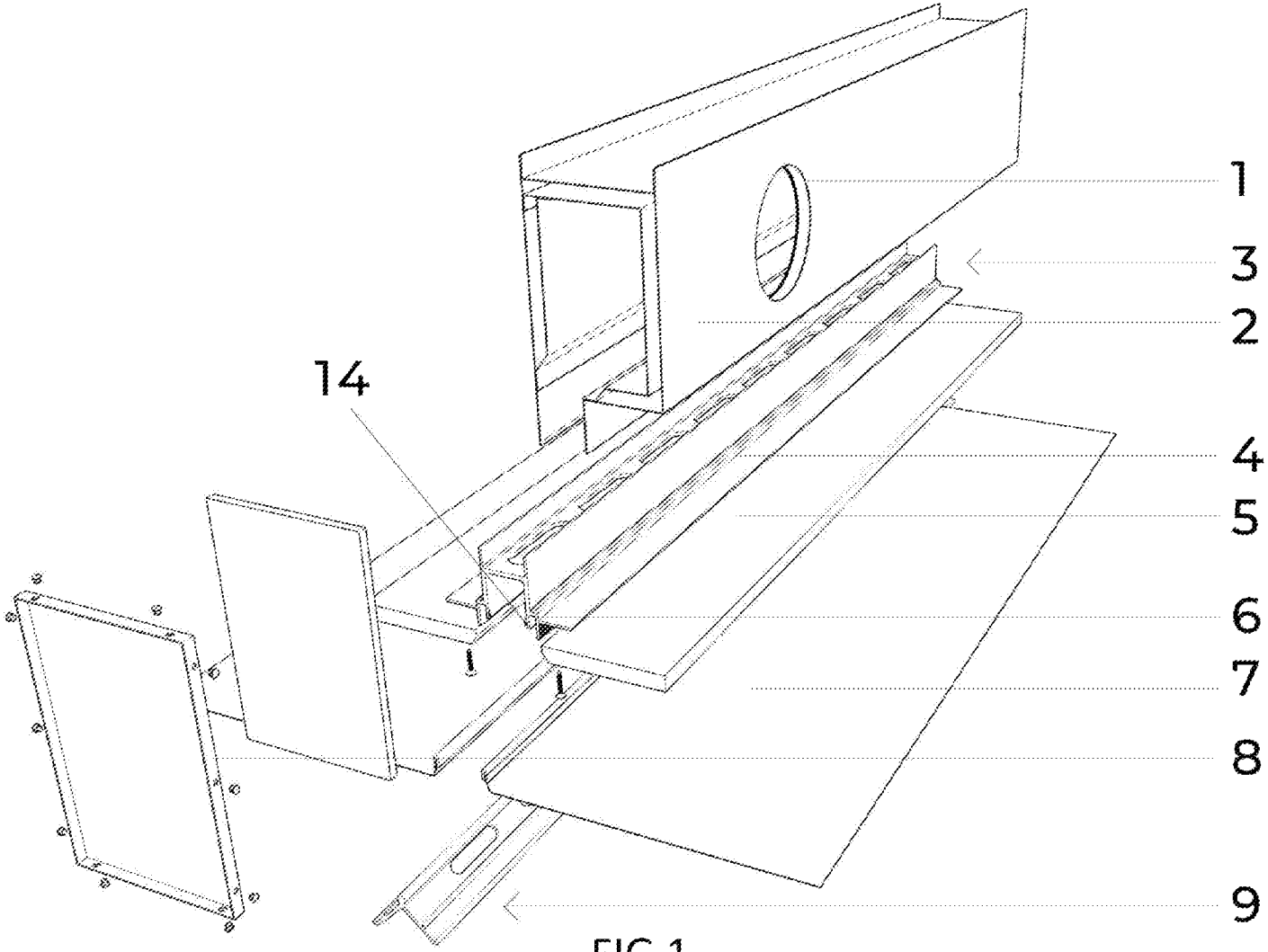
FIG. 1 is a layout view of the linear air diffuser of suspended ceilings together with a ventilation unit and materials of the suspended ceiling.
Figure 2:
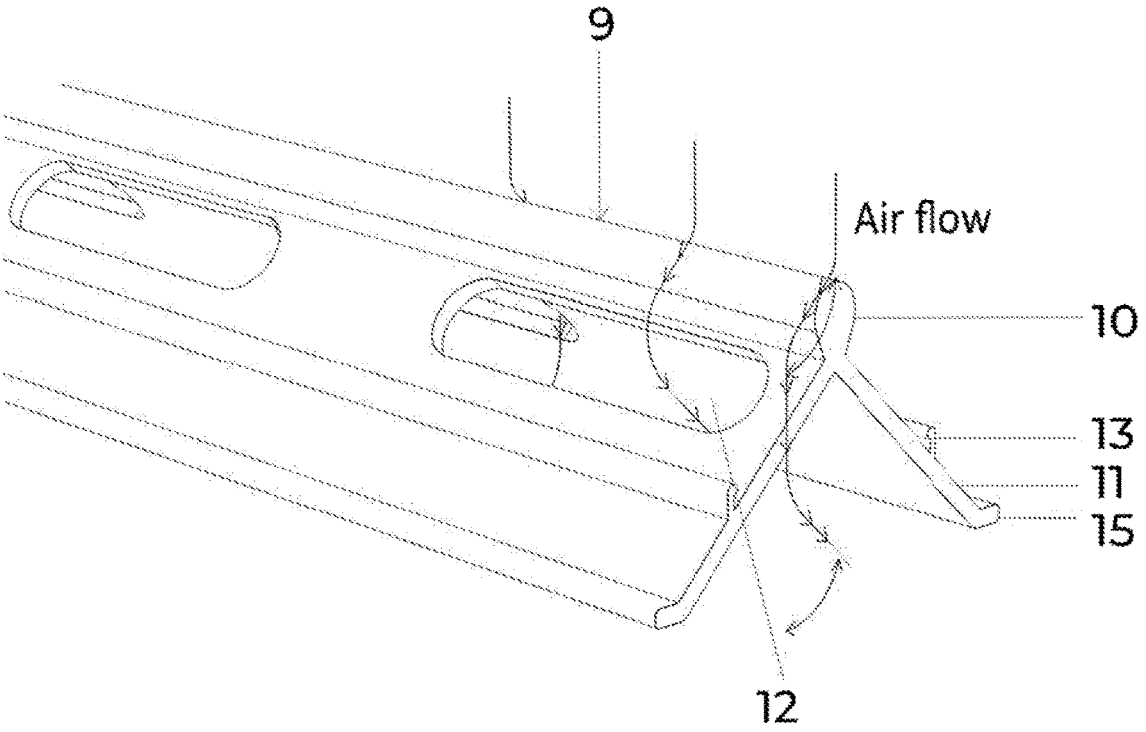
FIG. 2 shows the air deflector profile.
Figure 3:
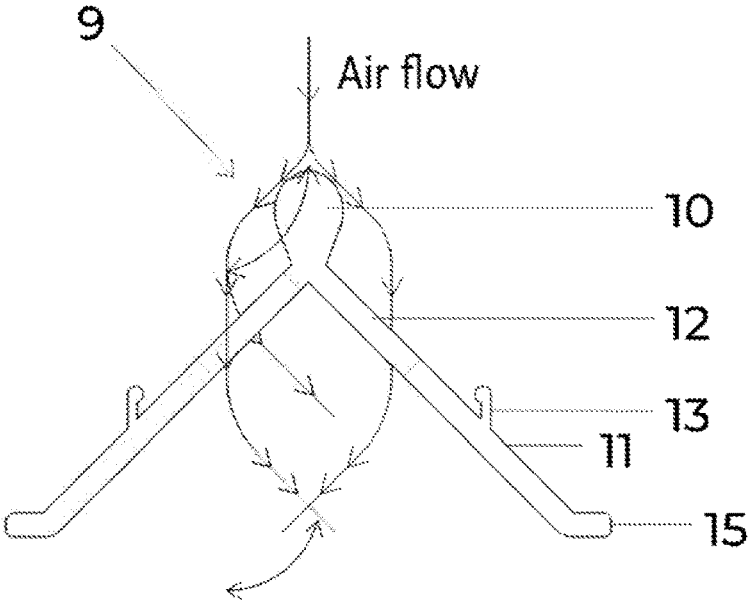
FIG. 3 shows a cross-section of the air deflector profile.

The linear air diffuser of a suspended ceiling comprises a double-chamber ventilation unit 2 for indoor premises, a ventilation opening 1 and an air flow regulator, a perforated mounting profile 3 connected to the air outlet part together with an air deflector profile 9 mounted to it. At the ends of the plenum box 2 there is a cap 8 with seals. The plenum box 2 is attached to the mounting brackets of the base ceiling by means of airproof riveting.

Mounting profile 3 is an H profile, where the top is in U shape and the bottom is in upside down U shape and the horizontal connection surface of these is perforated. The outer side of the bottom part of the mounting profile 3 has downwards channels 6 for harpoon mounting of the stretch ceiling material 7. In addition, a mounting bracket 4 is formed at the right angle to the outer side of channel 6, with vertical grooves on the external wall of the vertical part. The mounting bracket 4 is intended for mounting suspended ceiling materials 5 to the mounting profile 3.

At the lower end of the inner sides of the lower part of the mounting profile 3 is a groove 14 which opens downwards, intended for mounting the air deflector profile 9.

The air deflector profile 9 consists of two lateral sides 11 with slits 12 and connected at an acute angle, which are joined at the upper point of contact with a drop-shaped air deflector 10. The air deflector 10 with a drop shape follows the known rules of aerodynamics, guiding the air from the plenum box 2 of the ventilation unit via the perforated mounting profile 3 through the slits 12 of the air deflector profile 9 into the room uniformly and at the appropriate angle. In the middle of the lateral sides 11, the air deflector profile 9 comprises a vertical protrusion 13 with a widened end by which the air deflector profile 9 is mounted to the groove 14 of the ventilation profile 3, and a bottom edge 15 of the lateral edge at the open end of the lateral edge, protruding horizontally from the lateral edge 11. In mounting the air deflector profile 9 to the ventilation profile 3, the bottom edge 15 of the lateral side covers the mounting part of the stretch ceiling material 7, allowing thereby supplementary fixing thereof to the ventilation profile 3 and better stretching of the stretch ceiling material 7 and covers the connection point of the ventilation profile 3, stretch ceiling material 7 or suspended ceiling material 5 and ventilation profile 3. This ensures that the suspended ceiling with a ventilation profile has aesthetic appeal.

Cleaner air can move from the ventilation unit through perforated mounting profile via air diffuser profile directly into the room and become uniformly and at the appropriate angle diffused in the room by virtue of the special shape of the air diffuser.

This invention allows installation of stretch ceilings and ceilings of supplementary suspended ceiling materials (such as gypsum, boarding, metal strips, etc.). For example, a stretch ceiling combined with gypsum boards is preferred. The external wall of the vertical part of the mounting bracket 4 has grooves to ensure proper grip of the suspended ceiling material 5 and stability over the mounting bracket 4 (incl. also filler or any other sealant applied between the suspended ceiling material 5 and vertical side of the mounting bracket).

The slit structure 12 of the air diffuser profile 9 also eliminates deflection from the stretch ceiling caused by the difference in air pressure. This solution provides an additional possibility and useful feature whereby various suspended ceiling materials can be used simultaneously in one room while ensuring the necessary air circulation in the room.

As the invention crosses through the suspended ceiling, it can also be used as a partition in stretch ceiling. Due to the characteristics of the material of stretch ceilings, stretch ceilings can be normally made from parts with the maximum size of 50 $m^2$. By using a linear air diffuser as a ceiling partition, the ceiling of a room of any size can be covered with a stretch ceiling material.

The invention claimed is:

1. A linear air diffuser for a suspended ceiling for use indoors, the linear air diffuser comprising:

a ventilation unit comprising an insulated double chamber plenum box, a ventilation opening, and an air flow regulator, the linear air diffuser further comprises a mounting profile mounted to an air outlet part of the ventilation unit, and an air diffuser profile mounted to the mounting profile, and the air diffuser profile consisting of two lateral sides with slits, wherein the two lateral sides are connected at an acute angle and a drop-shaped air deflector connected at a top of the two lateral sides, wherein:

the mounting profile is formed of an H-profile having a perforated horizontal connection surface, and an upper and a lower part, and a downwards duct for attaching a stretch ceiling material is located at bottom of external sides of the lower part;

on an outer side of the downwards duct is a mounting bracket at a right angle, where an external wall of a vertical part of the mounting bracket has vertical grooves and the mounting bracket is intended for attaching a suspended ceiling element;

at a lower end of inner sides of the lower part of the mounting profile is a groove which opens downwards for attaching the air deflector profile;

each of the two lateral sides of the air deflector profile has at a middle a vertical protrusion with a widened end for mounting the air deflection profile to the groove of the mounting profile and a bottom edge of each lateral side of the air diffuser profile projects horizontally for additional support for the suspended ceiling element and for covering a connection point of the stretch ceiling material and the suspended ceiling element.

2. The linear air diffuser for the suspended ceiling according to claim 1, wherein the suspended ceiling element is of gypsum board.

3. The linear air diffuser for the suspended ceiling according to claim 1, wherein the suspended ceiling element is of boarding material.

4. The linear air diffuser for the suspended ceiling according to claim 1, wherein the suspended ceiling element is of metal strips.

5. The linear air diffuser for the suspended ceiling according to claim 1, wherein the linear air diffuser is a partition in a stretch ceiling by crossing through the suspended ceiling.

* * * * *